US007210391B2

(12) United States Patent
Beckmann

(10) Patent No.: US 7,210,391 B2
(45) Date of Patent: May 1, 2007

(54) ADJUSTABLE GUN CARRIAGES

(75) Inventor: Rudi Beckmann, Schwanenmoos (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 11/072,213

(22) Filed: Mar. 4, 2005

(65) Prior Publication Data

US 2006/0048642 A1 Mar. 9, 2006

(30) Foreign Application Priority Data

Sep. 9, 2004 (DE) ..... 10 2004 043 711

(51) Int. Cl.
*F41A 23/00* (2006.01)

(52) U.S. Cl. ..... 89/37.03

(58) Field of Classification Search ..... 89/37.03, 89/40.06, 41.01, 40.01
See application file for complete search history.

(56) References Cited

U.S. PATENT DOCUMENTS 1,335,403 A * 3/1920 Stanley ..... 89/40.06
1,805,547 A * 5/1931 Ironside ..... 89/40.06
2,412,109 A * 12/1946 Trotter ..... 89/37.17
2,441,874 A * 5/1948 Evans ..... 89/37.03
2,452,147 A * 10/1948 Reinhold et al. ..... 89/41.01
2,458,956 A * 1/1949 Motley ..... 89/37.03
2,486,526 A * 11/1949 Gross ..... 89/134
2,566,855 A * 9/1951 Rose ..... 89/37.01
2,596,223 A * 5/1952 Eastman ..... 89/41.15
2,764,915 A * 10/1956 Weiss ..... 89/41.01
2,782,687 A * 2/1957 Heinrich ..... 89/41.01
2,841,887 A * 7/1958 Clark ..... 434/19
2,858,740 A * 11/1958 Harring et al. ..... 89/40.01
3,233,517 A * 2/1966 Morrison ..... 89/40.06
3,306,166 A * 2/1967 Ramseyer ..... 89/41.01
4,686,888 A * 8/1987 Sanborn et al. ..... 89/37.13
2003/0051599 A1* 3/2003 Lundqvist et al. ..... 89/37.03
2004/0159229 A1* 8/2004 Urvoy ..... 89/41.01

* cited by examiner

*Primary Examiner*—Michelle Clement
*Assistant Examiner*—Benjamin P. Lee
(74) *Attorney, Agent, or Firm*—Hanley, Flight & Zimmerman, LLC

(57) ABSTRACT

Adjustable gun carriages are disclosed. An example gun carriage includes: a coarse height adjustment brake; a coarse side-to-side adjustment brake; a fine height orientation adjustment mechanism; a fine side-to-side orientation adjustment mechanism; a first control to actuate the coarse height adjustment brake; a second control to actuate the fine height orientation adjustment mechanism; a third control to actuate the coarse side-to-side adjustment brake; and a fourth control to actuate the fine side-to-side orientation adjustment mechanism.

38 Claims, 12 Drawing Sheets

ADJUSTABLE GUN CARRIAGES

FIELD OF THE DISCLOSURE

This disclosure relates generally to firearms, and, more particularly, to adjustable gun carriages for use with firearms such as machine guns.

BACKGROUND

Firearms such as, machine guns, grenade throwers, other automatic weapons, etc., are commonly mounted on adjustable gun carriages. These gun carriages may be positioned on a suitable base (e.g., a tripod) on the ground, on a vehicle, or on a building and are designed to facilitate aiming and firing of the mounted weapon.

An adjustable gun carriage should meet various criteria: For example, it should be smoothly and precisely adjustable to facilitate accurate aiming and target coverage. Also, the gun carriage should not impede the handling of the weapon, but rather, should improve such weapon handling. A gun carriage should also be precise and stable during the adjustment process. If used with, for example, a weapon that shoots grenades, the gun carriage should be height adjustable and side-to-side rotatable in order to increase the ammunition effect in the target area. Gun carriages should also be suitable for use with different types of weapons while providing consistent handling. Traditional gun carriages only meet these requirements partly or inadequately.

DETAILED DESCRIPTION

Figure 6:
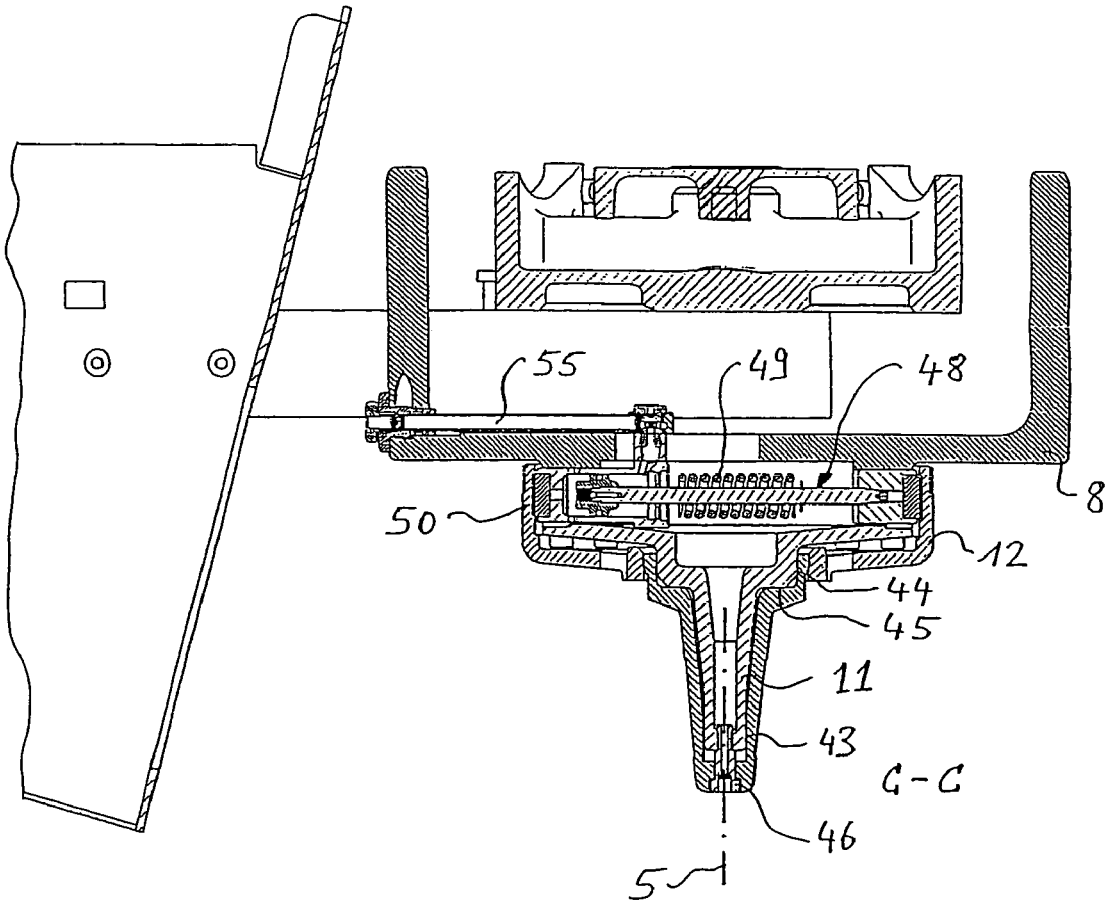
FIG. 6 is a partial cross-sectional view of the example gun carriage illustrating the area of the pivot pin along line C—C of FIG. 3.
Figure 7:
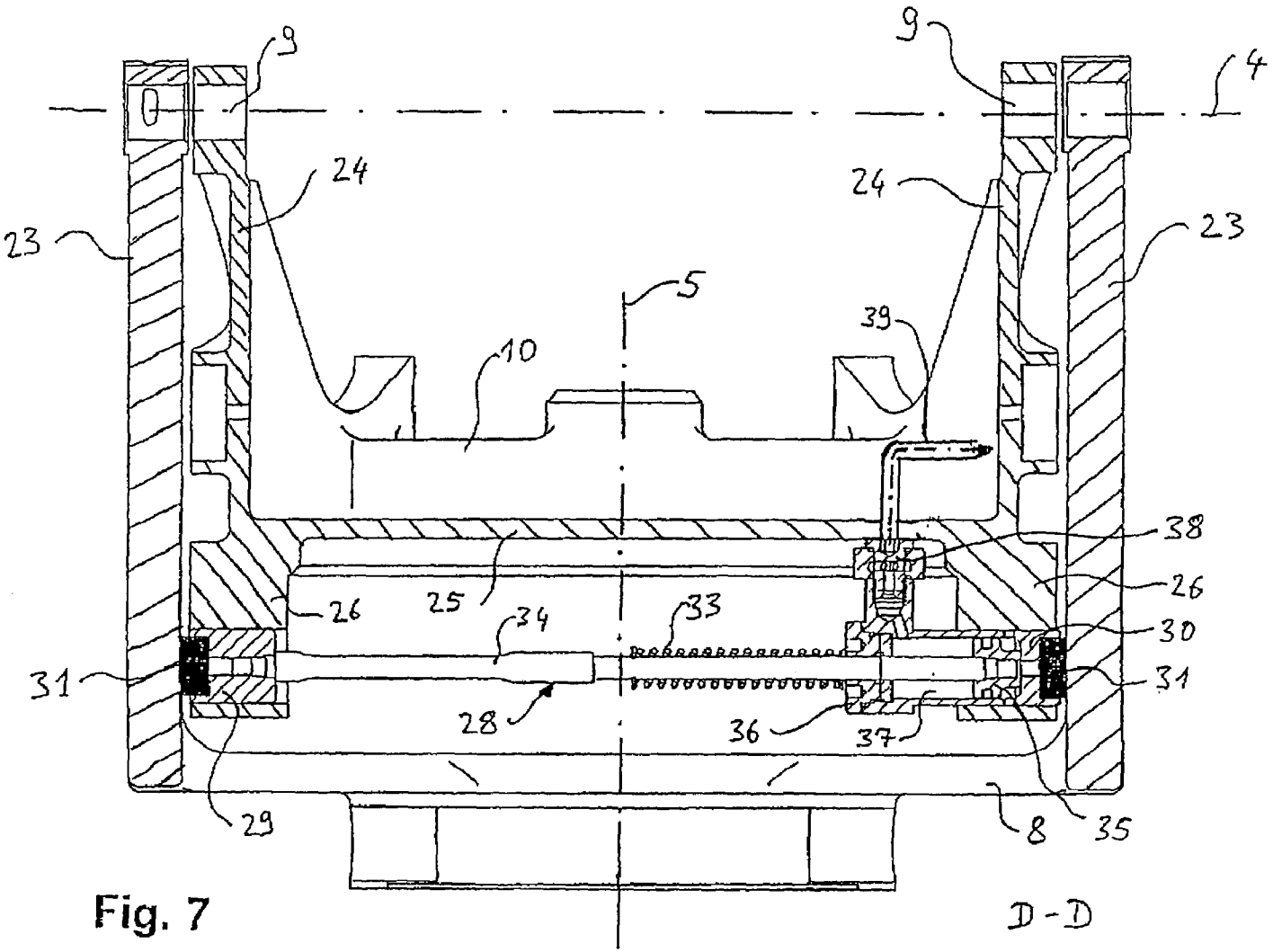
FIG. 7 is a partial cross-sectional view of the example gun carriage illustrating the area of the trunnions along line D—D of FIG. 3.
Figure 8:
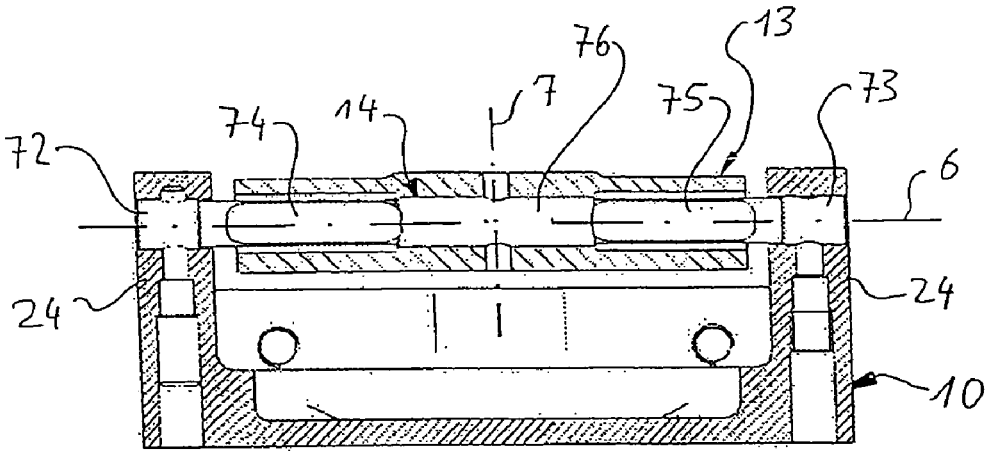
FIG. 8 is a cross sectional view through the base and gun mounting plate in the area of the joint rod of the example carriage of FIGS. 1–7.

An example adjustable gun carriage is shown in FIGS. 1–10. The illustrated gun carriage (1) is adjustable in that it enables both height adjustment (e.g., adjustment of the angle of the barrel of a weapon mounted on the carriage (1) relative to a horizontal plane) and side-to-side rotation of a weapon (2) mounted on the gun carriage (1). By suitable adapters (3), it is possible to mount various weapons (2) on the illustrated gun carriage (1) without having to make any structural alterations to the weapon (2') or to the gun carriage (1). In the example gun carriage (1) of FIGS. 1–10, it is possible to adjust the height of the weapon (e.g., the angular orientation of the weapon relative to a horizontal plane) by pivoting the carriage about a horizontally oriented height direction axis (4). It is also possible to adjust the angular orientation of the weapon by pivoting the carriage side-to-side about a vertically oriented, side direction axis (5). In addition, as shown in FIG. 8, it is also possible to more finely or precisely adjust the height orientation of the weapon about a horizontally oriented, height direction axis (6) and the side-to-side angular orientation of the weapon about a vertically oriented, side direction axis (7).

Figure 1:
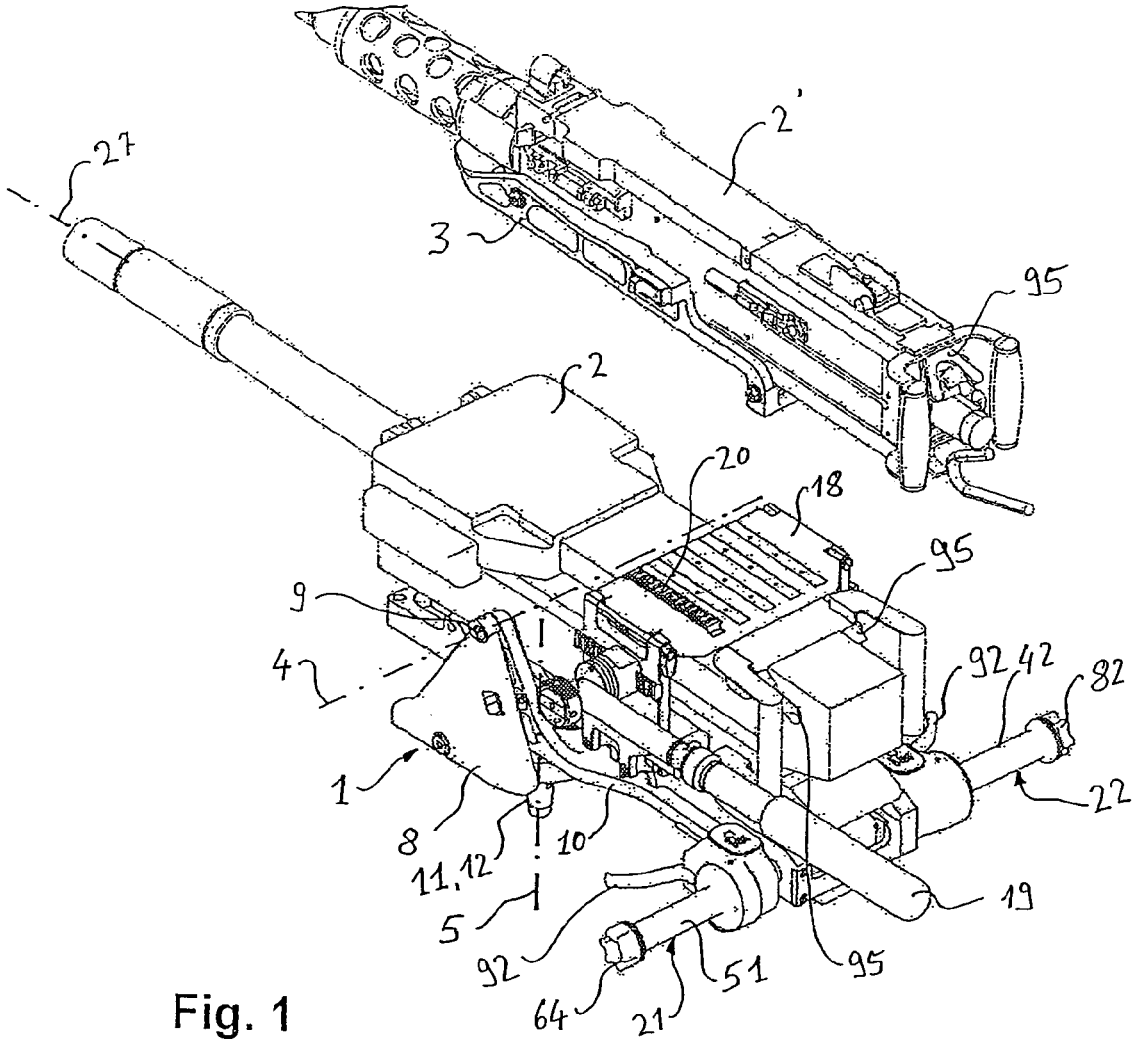
FIG. 1 is a perspective view of an example gun carriage illustrated with a first weapon mounted on the carriage and a second weapon mounted on an adapter for mounting to the gun carriage in place of the first weapon.
Figure 2:
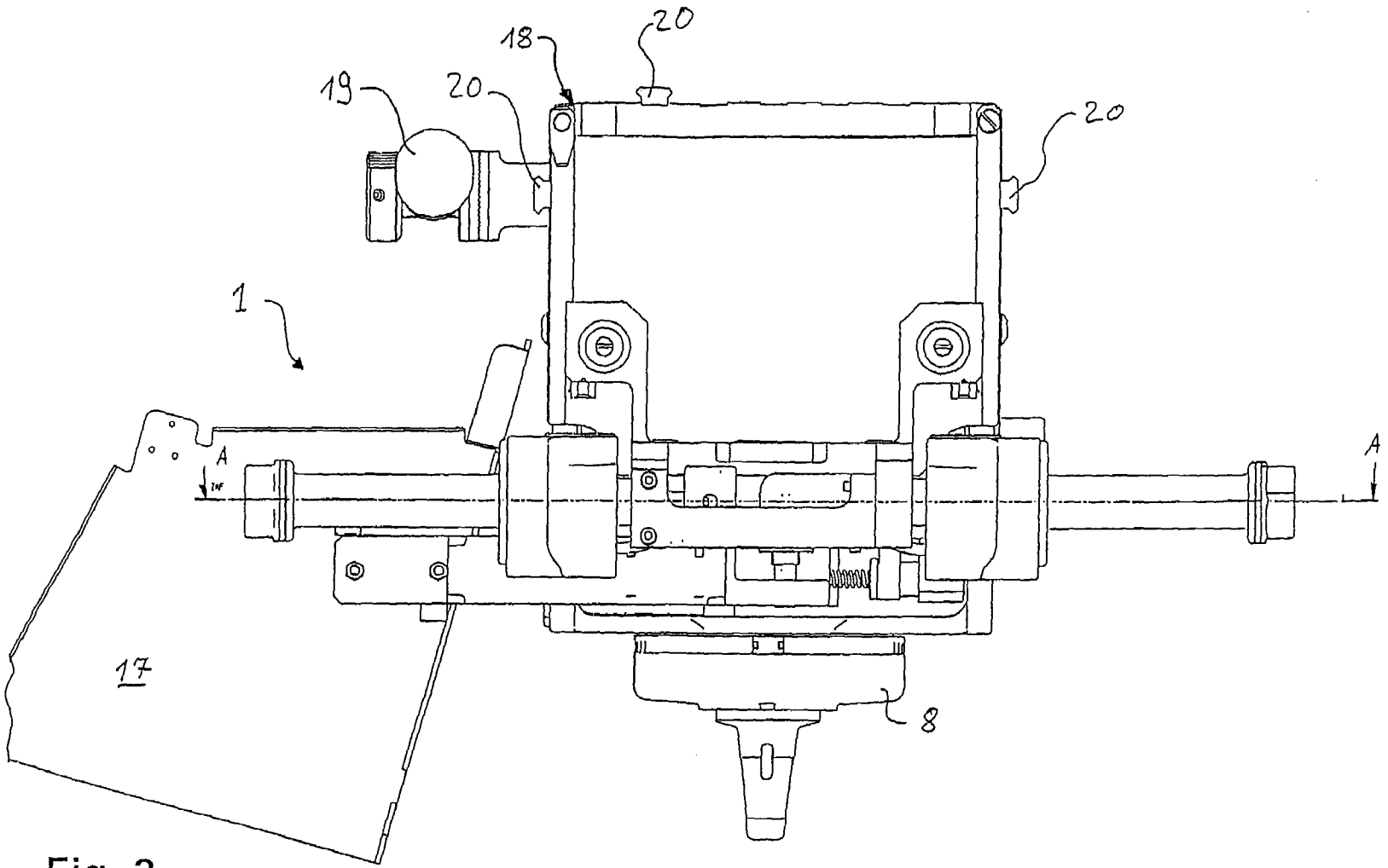
FIG. 2 is a rear view of the example gun carriage of FIG. 1.
Figure 3:
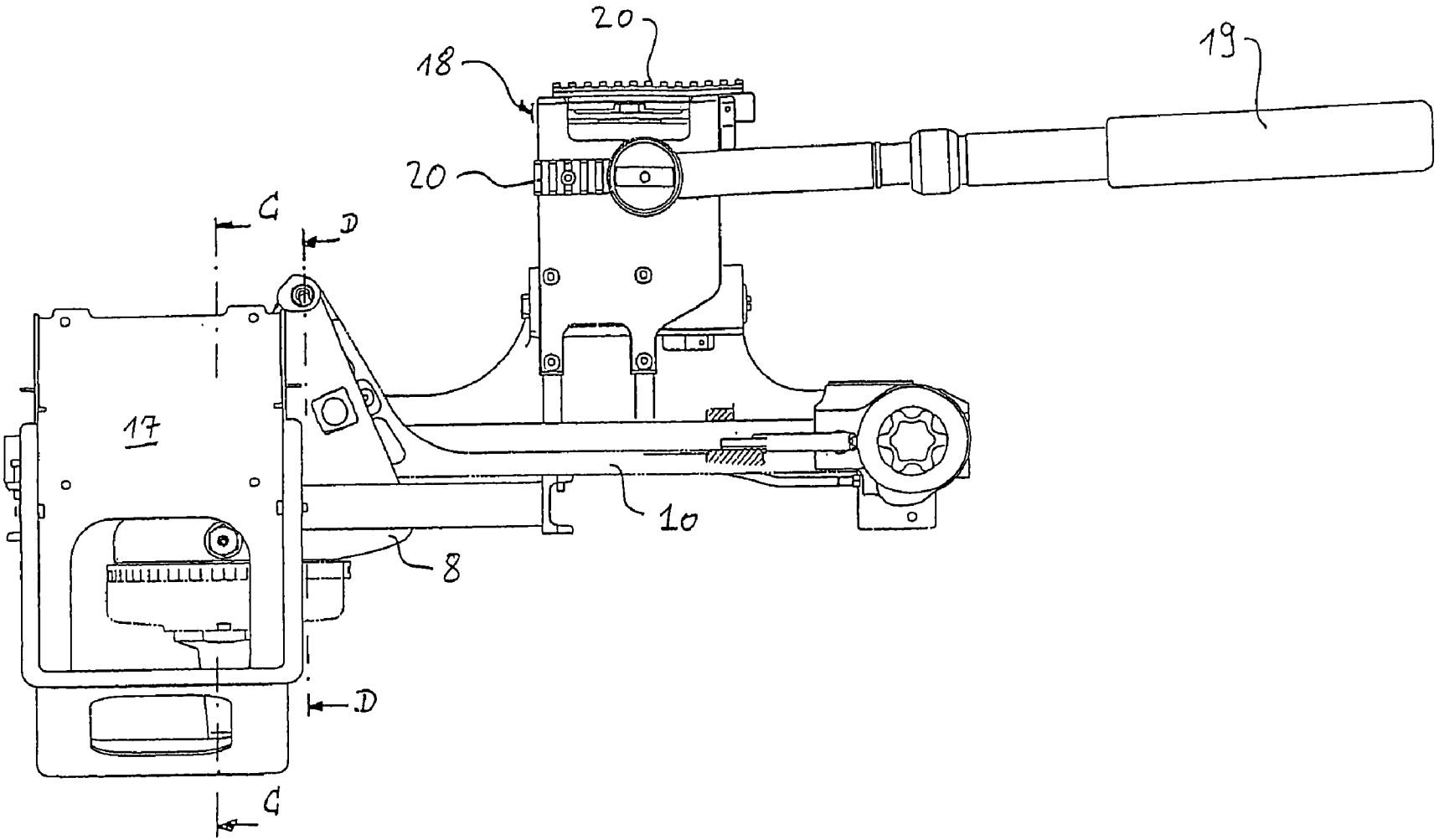
FIG. 3 is a side view of the example gun carriage of FIG. 2.
Figure 11:
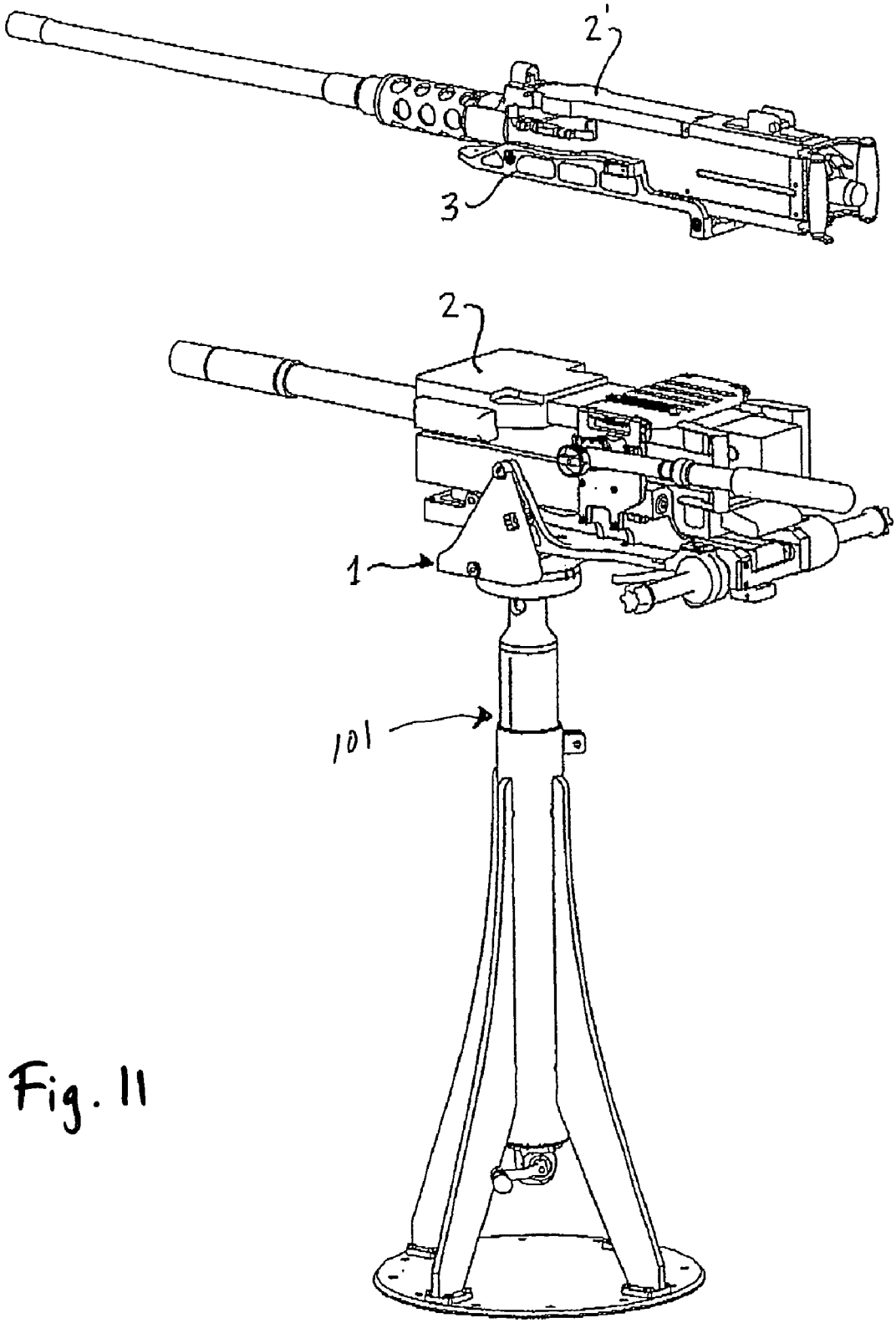
FIG. 11 is a perspective view of an example gun carriage illustrated with a first weapon mounted on the carriage which is mounted on a tripod and a second weapon mounted on an adapter for mounting to the gun carriage in place of the first weapon.
Figure 12:
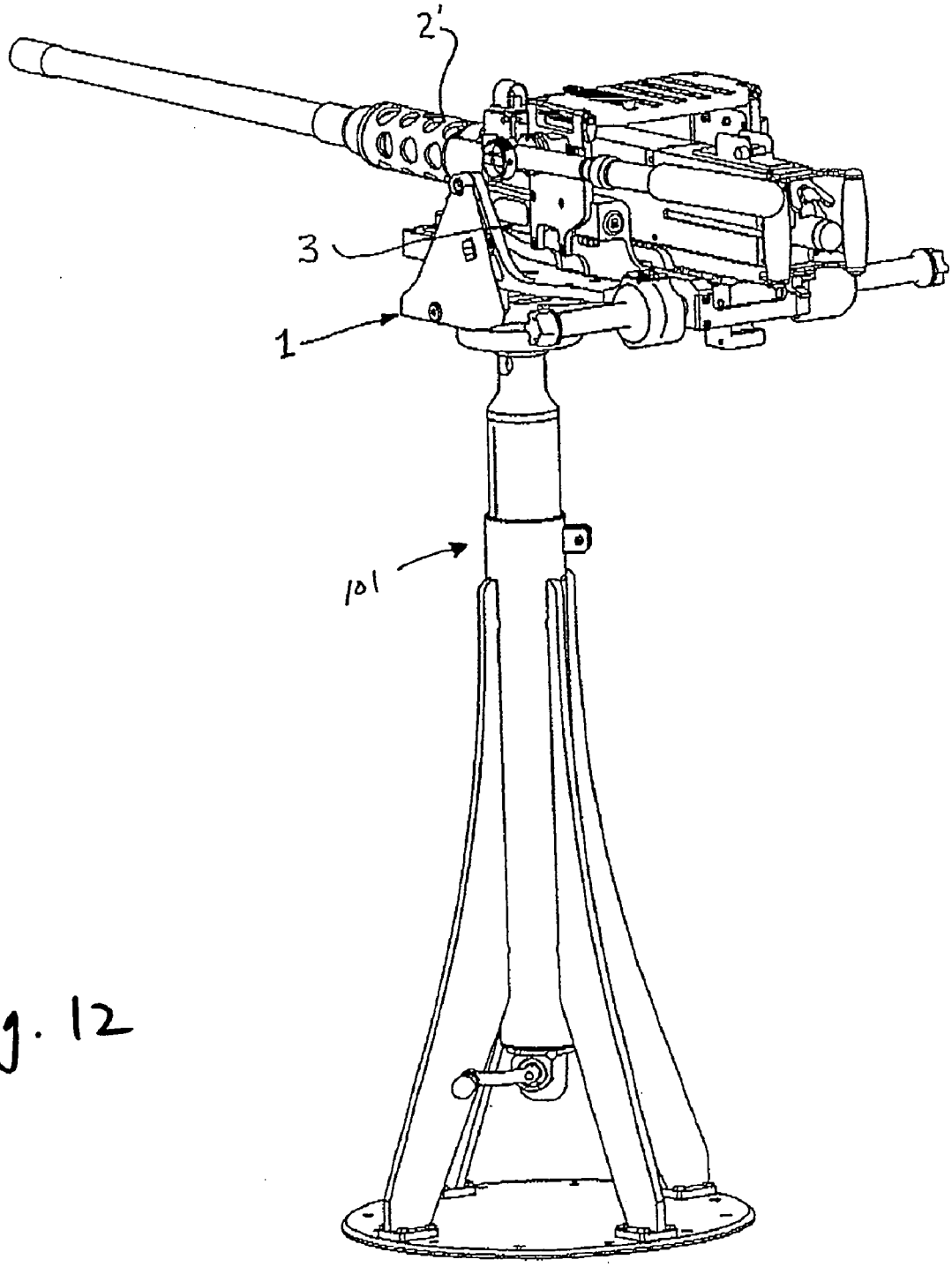
FIG. 12 is a perspective view of the second weapon and adapter of FIG. 11 mounted the carriage and tripod of FIG. 11.
Figure 13:
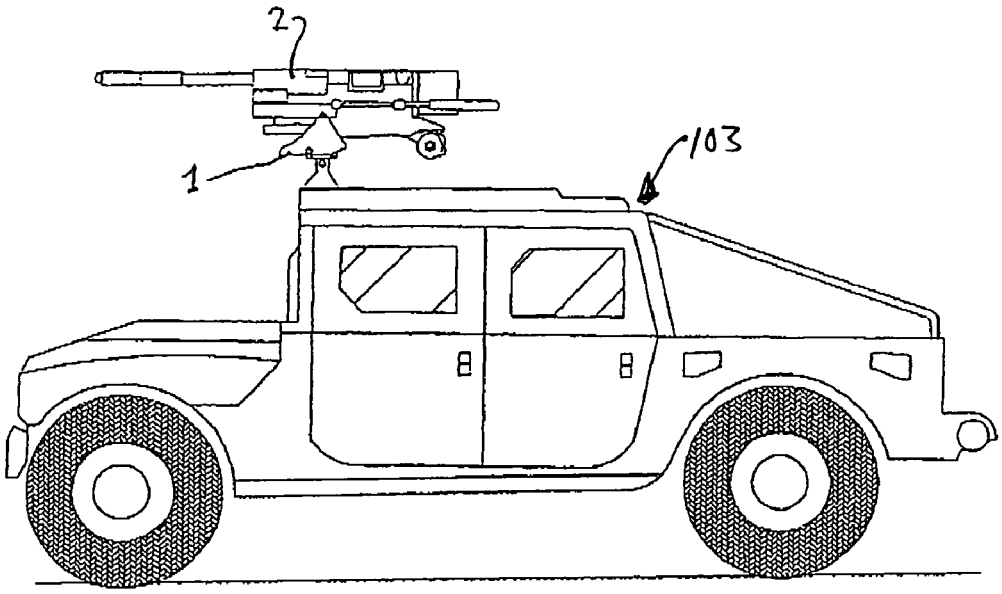
FIG. 13 is a side view of the weapon and carriage of FIG. 1 mounted on a vehicle.

The gun carriage (1) includes a pivot dish (8). A base in the form of a pivot fork (10) is suspended by trunnions (9) within the pivot dish such that the base (10) may be vertically pivoted about the height direction axis (4). As shown in FIGS. 1 and 7, the height direction axis (4) runs through the two trunnions (9). The pivot dish (8) is mounted on a swing-out drum. The swing out drum is shaped as a bearing box (12) and includes a pivot pin (11) which protrudes vertically downward from the bearing box 12 (see FIG. 6). The pivot pin (11) is aligned with and may be pivoted about the side directional axis (5). The bearing box (12) is securely attached to a secondary base, (not shown), which connects the gun carriage (1) with, for instance, a tripod (101). The tripod (101) may be secured on the ground, on a vehicle (103), or on a building, or the carriage may be mounted directly to a vehicle (103) or building (see FIGS. 11–13).

As shown in FIGS. 1, 4, and 6–9, a weapon (2, 2') may be securely attached to a gun mounting plate (13) either directly or via an adapter (3). In the illustrated example, the gun mounting plate (13) is adjustable relative to the pivot fork (10). For example, the gun mounting plate (13) is vertically adjustable (e.g., pivotable about the height adjustment axis (6)) and/or horizontally adjustable (e.g., pivotable about the side adjustment axis (7)). To this end, the gun mounting plate (13) and the pivot fork (10) are connected via a joint rod (14) (see FIGS. 8 and 9) and via two adjustment transmission units (15 and 16) (see FIGS. 4 and 5). The adjustment transmission unit (15) serves the purpose of adjusting the side-to-side rotational orientation of the mounting plate (13) relative to the fork (10) by pivoting the mounting plate (13) relative to the height adjustment axis (6). The adjustment transmission unit (16) serves the purpose of adjusting the height orientation of the mounting plate (13) relative to the fork (10) by pivoting the mounting plate (13) relative to the side adjustment axis (7).

In addition, the illustrated gun carriage (1) also includes a belt box attachment (17) (see FIGS. 2 and 3), a component frame (18), and an adjustable shoulder support (19). A weapon (2, 2') mounted on the carriage (1) may be supplied with an ammunition belt (not shown) from a belt box (also not shown) which is connected to the belt box attachment (17). It is possible to mount various accessories (e.g., a sight, a target device, night vision equipment, a range finder, a lamp, etc.) on the component frame (18) via adapter rails (20). In the illustrated example, the shoulder support (19) is attached to one of the adapter rails (20). As can be seen in FIG. 1, the adapter rail (20) carrying the shoulder support (19) is implemented as a so-called Picatinny rail.

In order to aim and fire a weapon (2, 2') mounted on the gun carriage (1), the gun carriage (1) is provided with two control units (21, 22), namely, a left control unit (21) and a right control unit (22). The left control unit (21) is located on the left side of the carriage (1) as viewed from the position of a shooter standing behind the carriage (1) and the right control unit (22) is located in the right side of the carriage (1). These control units (21, 22) include all the control elements needed to fire the weapon, to perform general height and side-to-side rotation adjustments of the carriage (1) relative to, for example, a tripod (101), and to perform more fine or precise height and side-to-side adjustments of the mounting plate (13) and a weapon attached thereto relative to the fork (10) and/or base (8) of the carriage (1).

For the purpose of adjusting the height orientation of a mounted weapon relative to a horizontal plane, the pivot fork (10) is suspended in the pivot dish (8) via two trunnions (9) (see FIG. 7). The trunnions (9) connect the sidewalls (23) of the pivot dish (8) to the sidewalls (24) of the pivot fork (10). In the illustrated example, the pivot fork (10) includes a secondary base (25) which joins the two side walls (24). Receivers (26) are coupled to the secondary base (25).

For the purpose of releasably securing the pivot fork (10) against pivoting movement relative to the pivot dish (8), the carriage (1) is further provided with a main brake mechanism (28). In the illustrated example, the main brake mechanism (28) is mounted to the receivers (26) of the pivot fork (10). As shown in FIG. 7, the example main brake mechanism (28) is oriented transversely to the principal axis (27) of the weapon. The brake mechanism (28) of the illustrated example includes two brake ends (29, 30). Each of the brake ends is located in a respective one of the receivers (26) and includes an external side brake pad (31). A spring (33) is mounted on a rod (34) in a loaded condition between a guideway (36) of the brake mechanism (28) and an axial locking device (32). The spring (33) forces the ends (29, 30) of the brake mechanism (28) apart so that the brake pads (31) frictionally engage opposite interior surfaces of the side walls (23) of the pivot dish (8). This frictional engagement releasably secures the pivot fork (10) against pivoting movement relative to the pivot dish (8), thereby determining the angular orientation of a weapon mounted on the carriage (1) relative to a horizontal plane.

In order to enable releasing of the brake mechanism (28) to permit adjustment of the position of the pivot fork (10) relative to the pivot dish (8), the end section (30) of the illustrated example defines a hydraulic chamber (37). The rod (34) extends into this chamber (37) through the guideway (36). The guideway (36) seals the chamber (37) while permitting the rod (34) to reciprocate relative to the hydraulic chamber (37) in response to adjustments in the hydraulic pressure within the chamber (37). By building a sufficient pressure via a hydraulic line (39) and the attachment (38), the piston is moved to the right within the chamber (37). This movement pulls the axial locking device toward (32) toward the guideway (36) thereby further compressing the spring (33) and shortening the external length of the brake assembly (28), (i.e., the distance between the outside faces of the break pads (31) is decreased). The braking force is, thus, reduced or eliminated because the brake ends (31) disengage their respective interior sidewalls (23).

To adjust the hydraulic pressure within the chamber (37), the chamber (37) is connected to the right control unit (22) via an attachment (38) and the hydraulic line (39). In the example right control unit (22) of FIG. 5, there is a hydraulic component (40) which includes a piston that is connected to a turning handle (42) via a steering rod (41)(see also FIG. 10). For the purpose of releasing the brake mechanism (28) to permit adjustment of the height orientation of the pivot fork (10) relative to the pivot dish (8), the shooter manually rotates the turning handle (42). The steering rod (41) transmits the rotary motion to a linear movement of the hydraulic piston which builds up pressure in the hydraulic line (39), and, thus, in the chamber (37) (FIG. 7). This increased pressure moves the piston (35) and the attached rod (34) to the right in FIG. 7 against the spring force of the spring (33) to shorten the total length of the brake mechanism (28). As a result, the brake pads (31) are detached from the sidewalls (23) of the pivot dish (8), and the pivot fork (10) is now free to rotate about the axis defined by the trunnions (9) (see FIG. 7). By moving the control units (21, 22) and, if required, the shoulder support (19), the shooter is now able to pivot the pivot fork (10) up and/or down to adjust the vertical orientation of the weapon (2, 2') mounted on the gun carriage (1).

When a desired position is reached, the shooter releases his grip on the turning handle (42). In response, the spring (33) forces the rod (34) to the left such that the brake end (29) moves to the left and the brake end (30) moves to the right in FIG. 7, which causes the brake pads (31) to engage the surfaces of the walls (23) to again secure the pivot fork (10) against pivoting movement relative to the pivot dish (8). The movement of the piston (35) under the influence of the spring (33) with respect to the chamber (37) presses hydraulic liquid out of the chamber (37) and back into the control unit (22) via the attachment (38) and the hydraulic line (39) (see FIGS. 5 and 7). The hydraulic component (40) in the control unit (22) responds to this inflow of fluid by exerting a reset force upon the turning handle (42) via the steering rod (41), to thereby return the handle (42) to its starting position. Thus, the pivot fork (10) will be secured relative to the pivot dish (8) until the handle (42) is again activated to make further adjustments.

For the purpose of adjusting the side-to-side rotational position of the weapon (2, 2') (see FIG. 6), the pivot pin (11) is attached to the bottom of the pivot dish (8). The pivot pin (11) is located inside the bearing box (12) and may be rotated relative to the bearing box (12) about the vertically oriented, side direction axis (5). Since the pivot pin (11) is secured to the pivot dish (8), rotating the pivot pin (11) relative to the bearing box (12) also rotates the pivot dish (8) relative to the bearing box (12). The pivot pin (11) has a lower cylindrical bearing area (43) and an upper cylindrical bearing area (44). In the example of FIG. 6, the lower cylindrical bearing area (43) has a different cross-sectional dimension than the upper cylindrical bearing area (44). The lower cylindrical bearing area (43) and the upper cylindrical bearing area (44) are surrounded by corresponding interior areas of the bearing box (12). A downward pointing bearing area (45), which runs radially to the side direction axis (5), is located on a corresponding opposite area of the bearing box (12). Consequently, radial as well as axial forces may be transmitted between the pivot dish (8) or pivot pin (11) and the bearing box (12). An attachment (46) secures the bottom of the pivot pin (11) to the bearing box (12) to ensure the pivot pin (11) is not pulled out while permitting rotational movement between the pivot pin (11) and the bearing box (12).

A second brake mechanism (48) is mounted in the upper area of the pivot pin (11) adjacent to the bottom of the pivot dish (8). The second brake mechanism (48) is analogous to the first brake mechanism (28). Thus, the second brake mechanism (48) includes opposed brake pads mounted on opposite ends of a telescoping rod, a spring (49) to force the brake pads apart in opposite directions, a hydraulic chamber containing a piston coupled to the rod, wherein adjusting the hydraulic pressure within the chamber moves the piston against the spring force to disengage the brake and/or releases the piston for movement under the influence of the spring (49) to engage the brake. When forced apart via the spring (49), the brake pads engage an inner surface of a brake-drum-like area (50) of the bearing box (12) to secure the pivot pin (11) and, thus, the pivot dish (8) against rotation relative to the bearing box (12). In this way, the pivot dish (8) is releasable secured to the bearing box (12), and the weapon (2, 2') is releasable held against side-to-side rotation.

Figure 5:
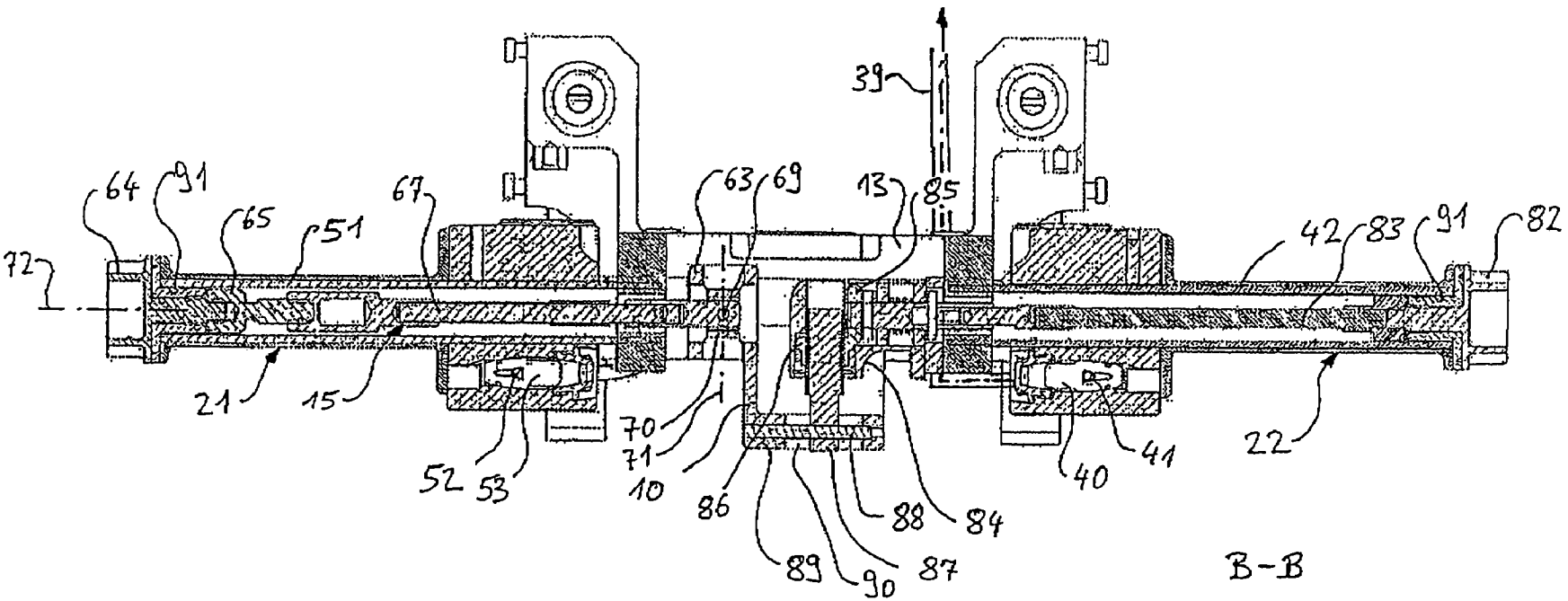
FIG. 5 is a partial cross-sectional view of the example control unit taken through line B—B of FIG. 4.
Figure 10:
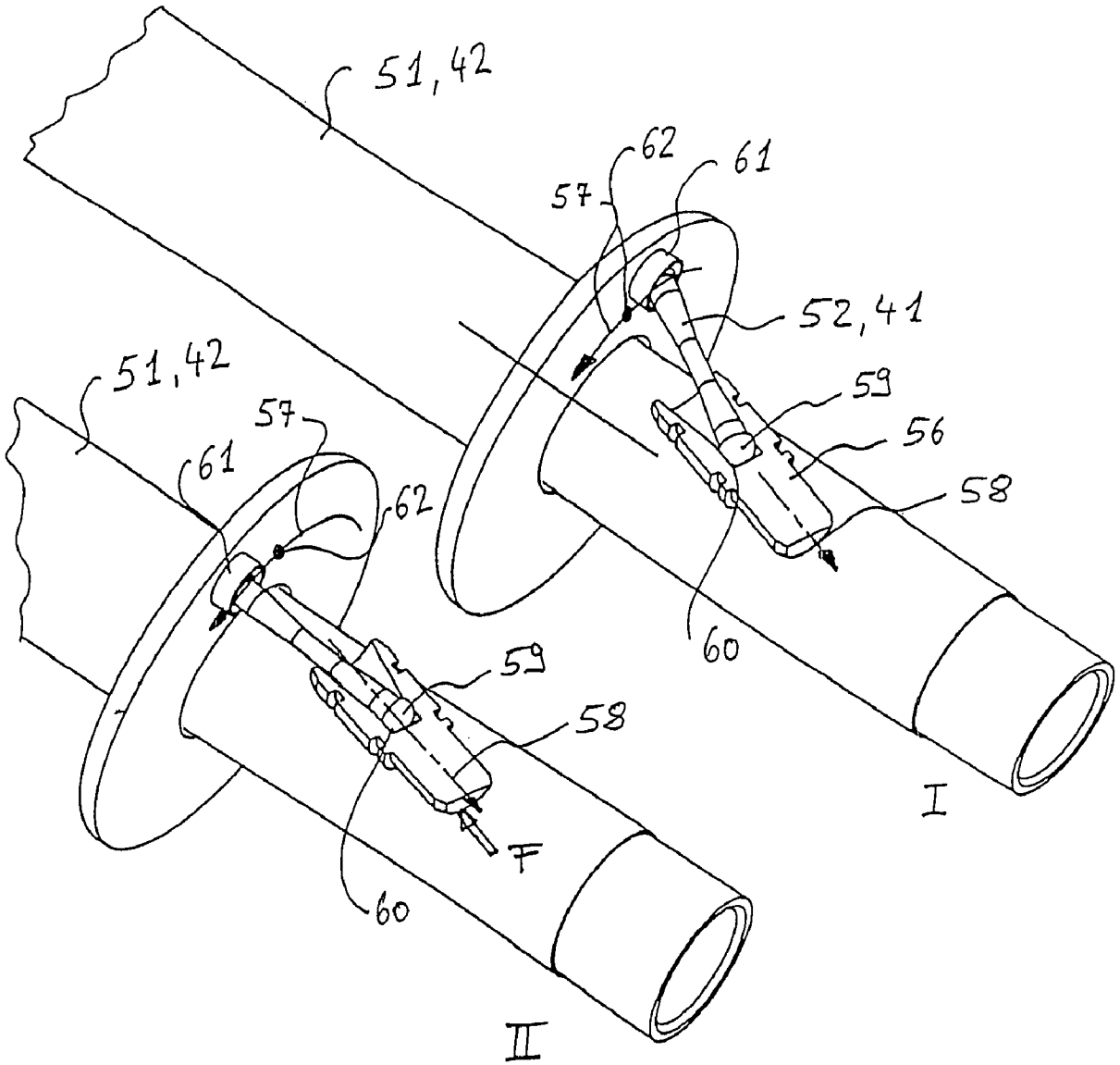
FIG. 10 is a perspective view of an example coupling between a turning handle and a hydraulic component shown in two control positions (I and II).

In order to adjust the side-to-side position of the pivot dish (8), the second brake mechanism (48) is activated via the left turning handle (51), a steering rod (52), and a hydraulic component (53) associated with the left control unit (21) and including a piston (see FIGS. 5 and 10). The left control unit (21) is in communication with the hydraulic chamber of the second brake mechanism (48) via a hydraulic line (55). Thus, analogous to the first control unit (22), rotation of the left turning handle (51) moves the piston which pushes fluid from the left control unit (21) to the hydraulic chamber of the second brake mechanism (48). The increased pressure in the hydraulic chamber releases the second brake mechanism (48) as explained above. Releasing the left turning handle (51), permits the spring (49) of the second brake mechanism (48) to force fluid back into the control unit (21) to thereby lock the second brake mechanism (48) and return the left turning handle (51) to its start position.

Because the shooter may operate the gun carriage (1) with one hand one each of the turning handles (42, 51) (i.e., one hand on the right control unit (22) and one hand on the left control unit (21), respectively), it is possible to adjust the side-to-side and height positions of the weapon (2, 2') or gun carriage (1) simultaneously. As a result, the weapon (2, 2') may be freely rotated and adjusted along the height and side direction axes (4, 5) via the turning handles (42, 51) with the brake mechanisms (28, 48) released.

FIG. 10 is a detailed view of an example turning handle (51, 42), steering rod (52, 41) and actuating piston (56) of the hydraulic components (40, 53). The actuating piston (56) is shown in cross-section. Drawing I shows the turning handle (51, 42) in a starting position. Drawing II shows the turning handle (51, 42) in a working position. From both drawings (I, II), it is apparent how the rotary motion of the handle (51, 42) is transferred in the direction of the arrow (57) via the steering rod (52, 41) into a linear movement in the direction of the arrow (58). On its respective ends, the steering rod (52, 41) has a spherical segment (59) which is received in a retainer (60, 61) of the actuating piston (56). The retainer (60) is tapered so that it is possible to adjust the angular position of the steering rod (52, 41) toward the turning handle (51, 42) or toward the actuating piston (56). In other words, a knee joint assembly is implemented, which has a dead center (62) in the adjustment range of the turning handle (51, 42). This dead center is selected such that the turning handle (51, 42) must be turned out of its position (I) and beyond the dead center (62) in order to release the corresponding brake (28, 48). As a result, the reset force (F) of the brake mechanism (28 or 48), which is transmitted to the actuating piston (56), acts on the steering rod (41, 52) to keep the turning handle (42, 51) in position (II) in the absence of another outside rotating force. In other words, the turning handle (51, 42) may be released without permitting the springs (33, 49) to return the brake mechanisms (28, 48) into the braking state. In this state, the gun carriage (1) may be horizontally and/or vertically rotated without resistance or wear. This operating mode is advantageous, for example, when seeking to track, detect, and/or battle moving targets. To return to the braking state, the turning handle(s) (51, 42) are turned back against arrow direction (57) beyond dead center (62) so that the reset force (F) exerted on the actuating piston(s) (56) by the spring(s) (33, 49) brings the turning handle(s) into the starting position (I). Consequently, the brake mechanisms (28, 48) may be released or held in a released position with or without any rotating force exerted on the turning handles (51, 42).

The hydraulic connection of the brake mechanisms (28, 48) with the turning handles (42, 51) allows for very direct control. With proper "hydraulic" transmission, it is also possible to overpower even high braking forces. A person of ordinary skill in the art will appreciate that connections, other than the illustrated hydraulic connection, (e.g., linkages or leverages) may alternatively be employed.

Figure 4:
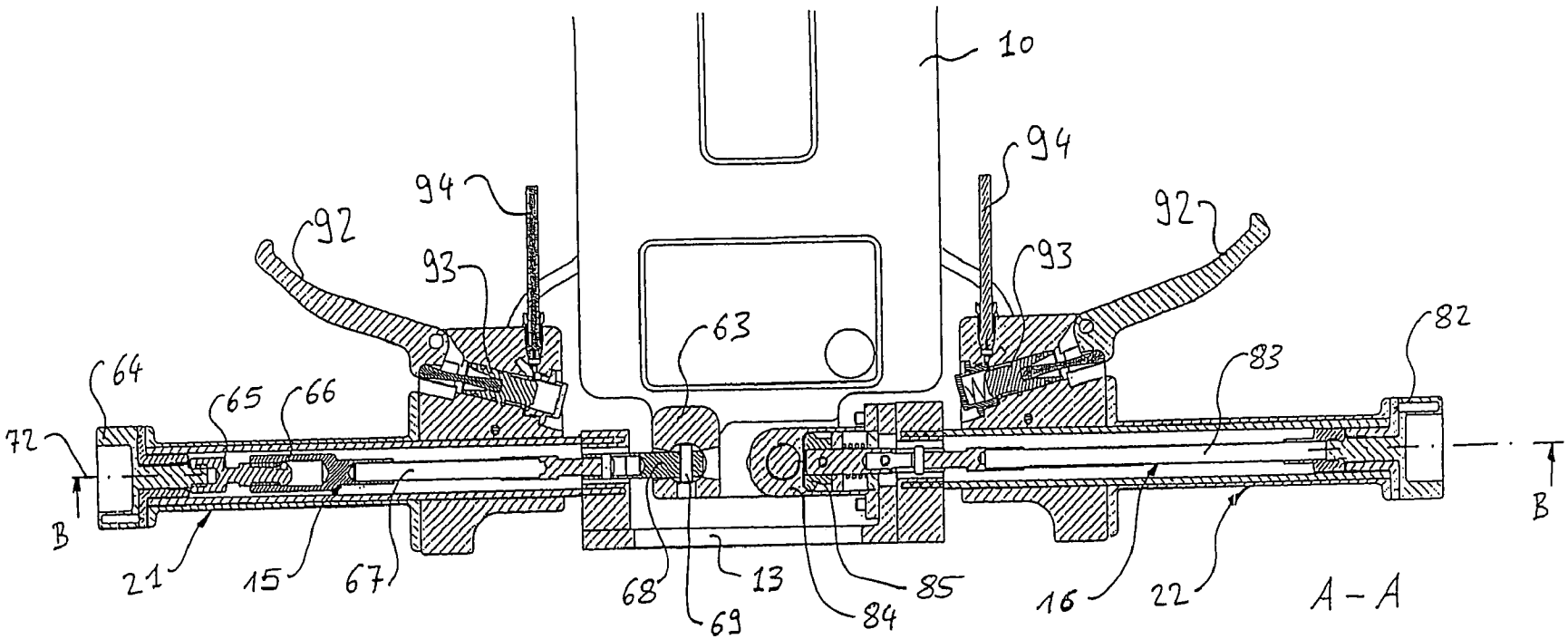
FIG. 4 is a partial cross-sectional view of the example control unit taken through line A—A of FIG. 2.

In addition to the adjustments described above, fine adjustments of the position of a mounted weapon (2, 2') relative to the pivot dish (8) of the gun carriage (1) may also be affected in the illustrated example. An example process of making fine height and side-to-side adjustments of the weapon (2, 2') relative to the pivot dish (8) will now be described with reference to FIGS. 4, 5, 8, and 9. As shown in FIG. 4, the left control unit (21) of the illustrated example is attached to the rear end (i.e., the side facing the shooter) of the gun mounting (13). The gun mounting (13) is coupled with a connecting piece (63) of the pivot fork (10) via an adjustment transmission unit (15). The adjustment transmission unit (15) is used to adjust the side-to-side position of the gun mounting (13) relative to the pivot fork (10). The adjustment transmission unit (15) includes a control gear (64), which engages in an inside thread sleeve (66) via an outside thread block (65). The inside thread sleeve (66) is connected to a coupling piece (68) via a rod (67). The rod (67) is attached to a socket (70) by a bolt (69) in the connecting piece (63). The illustrated socket (70) is vertically movable and may be pivoted in the connecting piece (63) around its axis (71) (see FIG. 5).

For the purpose of adjusting the side-to-side position of the gun mounting (13) relative to the pivot fork (10), the shooter turns the control gear (64) around the rotating axis (72). Due to this movement, the thread of the outside thread block (65), (which is connected torque proof with the control gear (64)), is screwed into or out of the inside thread sleeve (66), depending on the direction of movement of the control gear (64). When the control gear (64) is screwed into the inside thread sleeve (66), the total length of the adjustment transmission unit (15) is shortened. This shortening of the adjustment transmission unit (15) adjusts the side-to-side position of the gun mounting (13) relative to the pivot fork (10). Specifically, the rod (67) moves the connecting piece (63) over the coupling piece (68) and the socket (70) and, consequently, moves the rear end of the gun mounting (13) toward the connecting piece (63) of the pivot fork (10). Because the front end of the gun mounting (13) is connected with the pivot fork (10) via the joint rod (14), this movement causes the gun mounting (13) to rotate around the side adjustment axis (7) (see FIG. 8). As a result of this rotation, the joint rod (14) is warped or bent.

The joint rod (14) has two end sections (72, 73). Each of the end sections (72, 73) is connected to the middle section (76) via a tapered adapter (74, 75). In the example of FIG. 8, the joint rod (14) runs coaxial to the height adjustment axis (6). Each of the ends (72, 73) is interconnected to a respective retainer in opposite ones of the sidewalls (24) of the pivot fork (10). Specifically, one end (72) is attached with a screw bolt (77). The other end (73) is slidably interconnected in its respective retainer. The gun mounting (13) has a socket which receives the middle section (76) of the joint rod. This middle section (76) is secured via a bolt (not shown) which penetrates the retainer socket and the middle section (76).

Adjustments made via the adjustment transmission unit (15) cause the rear end of the gun mounting (13) to move in a horizontal direction (sideways) relative to the pivot fork (10) or to the connecting piece (63). The attachment of the joint rod (14) in the pivot fork (10) described above and the retainer socket (70) of the gun mounting permit rotary motion around the side adjustment axis (7). As a result, the tapered adapters (74 and 75) are flexed, and the end section (73) moves linearly in the sidewall (24) of the pivot fork (10). In the illustrated example, the adapters (74, 75) are flattened in the horizontal direction to increase their flexibility (see FIG. 8), while the cross-sectional area is completely developed in the vertical direction (see FIG. 9). This geometry increases the rigidity of the joint rod (14) in the vertical direction. As a result, the weight force of the weapon (2, 2') and associated structural parts causes no or only minimum warping or flexing of the joint rod (14).

Figure 9:
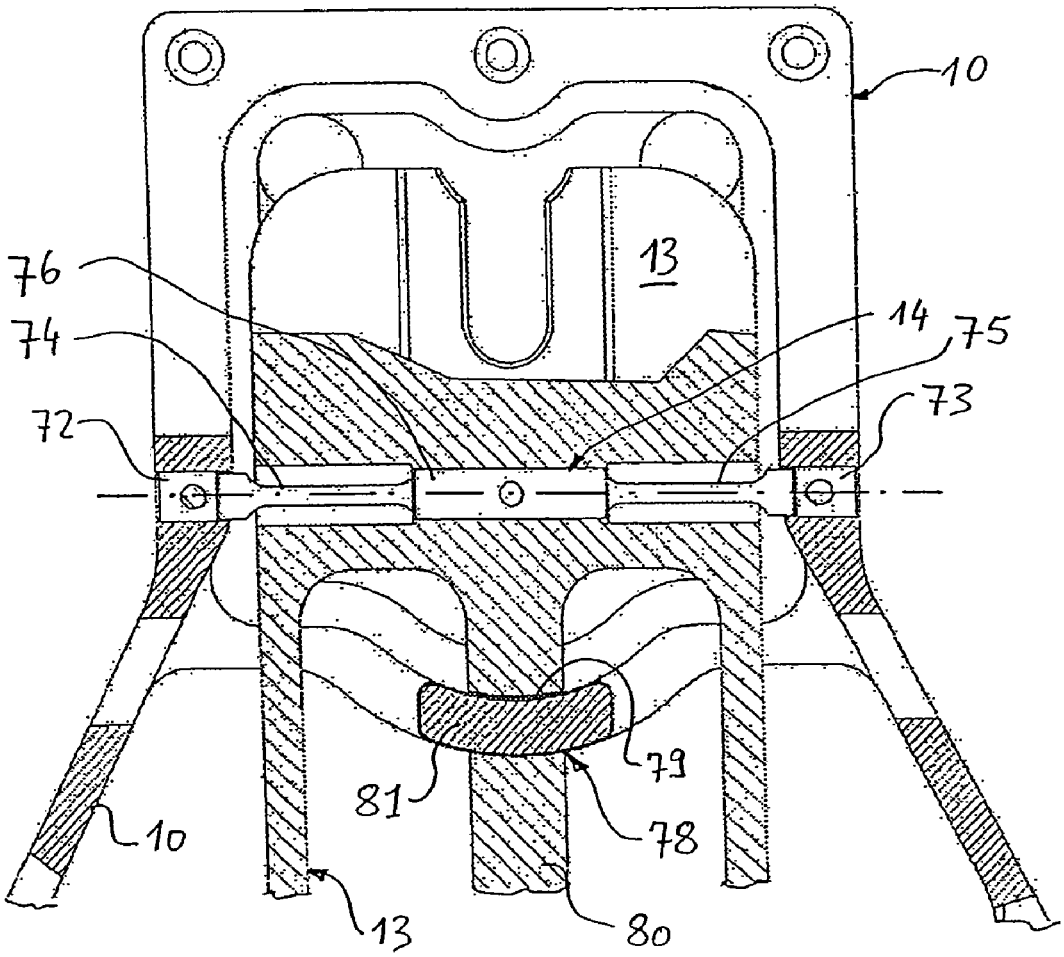
FIG. 9 is a top cross-sectional view through the base and gun mounting plate in the area of the joint rod of the example carriage of FIGS. 1–8.

FIG. 9 illustrates an additional guideway (78) for the purpose of receiving the recoil forces. This guideway (78) includes a curved guideway (79) running in a longitudinal ridge (80) of the gun mounting (13) and a curved cross nib (81) at the pivot fork (10). The radius of these curvatures corresponds to the distance between the guidance areas and the side adjustment axis (7). The cross nib (81) runs inside the guideway (79) and receives the recoil forces when the weapon is fired without straining and warping the joint rod (14) and without moving the weapon from its adjusted position. In some models, the guideway (78) is located inside the pivot fork (10), and the cross nib or a pin is on the gun mounting (13).

FIG. 5 illustrates an example adjustment transmission unit (22) for finely adjusting the height orientation of the gun mounting (13) relative to the pivot fork (10). The adjustment transmission unit (22) of FIG. 5 is constructed analogously to the adjustment transmission unit (15) for finely adjusting the side-to-side orientation of the gun mounting (13) relative to the pivot fork (10). The main difference between the transmission units (15, 22) is the fact that the control gear (82) is connected with a bell crank transmission (84) via a shaft (83). The bell crank transmission (84) includes bevel gears (85, 86). The vertically arranged bevel gear (86) has an inside screw thread which interacts with the outside screw thread of a control pin (87). The control pin (87) is coupled with an adapter base (89) via a cross bar (88). The adapter base (89) is connected to the pivot fork (10). Upon turning the control gear (82), the bevel gear (86) is powered by the shaft (83) and the bevel gear (85). Due to this rotation, the bevel gear (86) is moved vertically up or down along the outside screw thread of the control pin (87) to thereby move the rear end of the gun mounting (13) up or down. As a result of this movement, the joint rod (14) is torqued at the front end in the middle section (76), and the gun mounting (13) together with the weapon (2, 2') is rotated vertically up or down around the height adjustment axis (6).

In an alternative model (not shown), the joint rod (14) is constructed such that the end sections (72, 73) and the middle section (76) are connected torque proof with the pivot fork (10) or gun mounting (13) via a positive-fit connection. Such torque proof, positive-fit connections may be realized, for instance, by means of particular grooves, multi-sided profiles, or in other appropriate ways. In such a connection, both tapered adapters (74, 75) are torqued during the fine height adjustment process. The axial attachment of the end section (72) in the pivot fork and the gun mounting (13) on the middle section (76) could be carried out in the usual positive-fit or friction-locked manner (clamping fit, interference fit).

In other models, the joint rod is gimbal-mounted with two degrees of freedom. For instance, this could be accomplished by means of a rigid joint rod with a vertical drill hole. A bolt that is located on the bottom side of the gun mounting (13) is fed through the vertical drill hole. In this way, the gun mounting may be rotated horizontally around the axis of rotation of the bolt, and may also be rotated vertically around the axis of rotation of the rod.

As shown in FIG. 5, the socket (70) is slidably located in the connecting piece (63) so that it is vertically movable and horizontally movable toward the adjustment transmission unit (15) without having to apply bending forces. However, the suspension of the control pin (87) on the bolt (88) is performed such that, during the process of adjusting the side-to-side position of the mounting plate (13), it is possible to perform a movement of the holding frame (89) relative to the control pin (87) by moving the bolt (88) back and forth in the mounting hole of the control pin (87). For this purpose, the mounting frame (89) has a hole (90) (see FIG. 5).

The control gears (64, 82) have detents (91) so that it is only possible to turn the control gears from one indexed position to the next. As a result, depending on the thread pitch of the elements (65, 66; 86, 87), the gun mounting (13) may only be turned to a definite degree. To this end, the distance of the detents (91) and the thread pitches are selected such that the rotating angle between the rotating position of the control gear (64, 82) corresponds to a definite height or side angle difference which is aligned according to the weapon (2, 2') or the associated sights or target devices.

In some examples, the height adjustment or side-to-side adjustment may be performed by suitable hydraulic drives rather than by the illustrated spindle/linear transmission. In this regard, suitable hydraulic cylinder/piston assemblies assume the horizontal or vertical adjustment of the gun mounting (13) relative to the pivot fork (10) functionality. In such cases, there are respective hydraulic components on the control gears (64, 82).

In order to trigger the weapon (2, 2') mounted on the carriage (1), each control unit (21, 22) has an operating lever (92) (see FIG. 4). Each operating lever (92) is coupled to a hydraulic components (93), which, in turn, is connected via a hydraulic line (94) with an actuator (95) (see FIG. 1) which operates the trigger mechanism of the weapon (2, 2') to fire the weapon. For example, one actuator (95) may be configured to activate a single shot mechanism, and the other actuator (95) may be configured to activate a sustained fire mechanism. The hydraulic coupling of the illustrated example is particularly safe and low in maintenance. However, persons of ordinary skill in the art will appreciate that the coupling could alternatively be performed by suitable mechanical elements, such as linkages, leverages, gears, or triggers. Such mechanical elements may be operated, for example, electrically or electromagnetically.

The illustrated example gun carriage (1) provides a horizontal pivoting range (i.e., in the side-to-side direction) of 360° and a vertical pivoting range (i.e., in the height direction) of −10° to +40° relative to a horizontal plane. With suitable adjustment of the respective structural parts, it is also possible to construct other pivoting ranges.

In the illustrated example, the horizontal and vertical adjustment ranges of the gun mounting (13) relative to the pivot fork (10) are both ±20°. Adjusting either of the control gears (64, 82) from one indexed position to the next always results in an adjustment of 1' of the position of the gun carriage in either the height or side-to-side orientation depending on which gear (64, 82) is adjusted. 1' relates to an angle adjustment that corresponds to a deviation of one meter at one kilometer distance. Alternatively, the position difference between two indexed positions may correspond to a multiple or a fraction of the unit 1'. A person of ordinary skill in the art will appreciate that other variations or alternatives in the position difference may alternatively be employed.

From the foregoing, persons of ordinary skill in the art will further appreciate that the illustrated example gun carriage (1) permits continuous adjustment of the height and side-to-side orientation of a weapon mounted on the gun carriage (1). Such persons will further appreciate that the illustrated gun carriage (1) also includes secondary adjustment mechanisms to permit more precise adjustments of the height and side-to-side orientation of the mounted weapon, after the weapon is brought into a generally desired orientation via the primary adjustment mechanisms. The example gun carriage discussed above also includes actuators for triggering the firearm. In the illustrated example, these actuators are located adjacent control elements which enable the shooter to continuously operate the primary adjustment mechanism to adjust the generally height and/or side-to-side orientation of the weapon, and/or adjacent control elements which enable the shooter to operate the secondary adjustment elements to make more precise adjustments in the height and/or side-to-side orientation of the weapon after the generally desired orientation is reached via the primary adjustment mechanisms. Persons of ordinary skill in the art will also appreciate that the carriage (1) may be structured such that one control unit actuates the elements required to make general height or side-to-side orientation adjustments and to make more precise height or side-to-side orientation adjustments after the generally desired orientation of the carriage (1) is set. Alternatively, multiple control units, (e.g., preferably two) may be employed as in the illustrated example, so that the shooter may, for instance, operate one control unit for both continuously adjusting the general height orientation of the carriage/weapon and for more precise adjustment of height orientation with his right hand, and may operate another control unit which has a control element for continuous adjustment of the general side-to-side orientation of the carriage weapon and for more precise adjustment of the side-to-side orientation with his left hand.

Persons of ordinary skill in the art will further appreciate that these control units of the illustrated example are assembled on a handlebar and are located on the rear end of the firearm adjacent the shooter. In the illustrated example, the control units run transversely to the central axis of the firearm (e.g., to the bore of the firearm) on an axis running through both control units. One control unit includes at least one additional control element which preferably includes a hand lever for triggering the firearm.

Persons of ordinary skill in the art will further appreciate that the illustrated control unit includes a turning handle for actuating a spring-loaded brake mechanism to lock or fix the height and/or side-to-side orientation of the gun carriage (1). In the illustrated example, the right hand may be used to operate a turning handle to actuate a brake mechanism to lock or fix the height orientation, and the left hand may be used to operate a turning handle to actuate a brake mechanism to lock or fix the side-to-side orientation of the carriage (1). In the illustrated example, each turning handle is connected to a respective actuator which, upon actuation, releases the corresponding brake mechanism. As a result of the foregoing structure, the shooter may adjust the height orientation when the side-to-side orientation is locked and may adjust the side-to-side orientation when the height orientation is locked. Alternative, if he simultaneously activates both turning handles, the shooter is able to adjust the firearm horizontally (sideways) and vertically (in height). Persons of ordinary skill in the art will further appreciate that the hydraulic mechanism illustrated herein facilitates particularly secure and precise activation of a brake-releasing hydraulic device. The hydraulic mechanism is also self-cleaning.

In the illustrated example, each turning handle must be turned against a spring force to actuate the corresponding braking mechanism. By properly constructing the "hydraulic transmission," it is possible to overpower the braking force of a very strong spring by hand. Thus, the directional position could be firmly fixed by means of particularly designed brake systems. As a result, it is possible to avoid movement of the firearm due to firing, even in the case of heavy firearms or firearms with powerful recoil.

In the illustrated example, each turning handle is connected to a hydraulic component which, upon releasing of the handle, exerts a reset force on the turning handle under the influence of a spring. This reset force resets the turning handle into its starting position. As a result, upon releasing the turning handle, the gun carriage automatically locks in a fixed position. Moreover, the turning handle will accept a locked or fixed position if it is turned beyond dead center, which is at the edge of the turning area. In this locked position (beyond dead center), the turning handle is fixed in position by the force exerted on the hydraulic component so that it does not return into its starting position, even if the handle is released (unless, of course, it is moved back past dead center). Consequently, the brake remains released, and the firearm on the gun carriage (1) may be freely rotated into any orientation without turning or continuing to apply a turning force to the turning handle. Thus, when the turning handles are secured in the past dead center position, the handles are only used to position the firearm into the desired orientation. To reset, the handles must be moved past dead center in the other turning direction by manually turning the handles to overpower the resistance created by the over center lock. Once the over center lock is over powered, the turning handle automatically returns to its starting position in which the gun carriage is fixed.

To implement this over center lock of the turning handle, a connecting rod coupling is provided in the illustrated example. The connecting rod coupling transmits the rotation of the turning handle into a linear movement of the hydraulic component. The hydraulic component is designed as a piston cooperating with hydraulic fluid. A person of ordinary skill in the art will further appreciate that it is possible to have an optimum arrangement between the point of contact at the turning handle and point of contact at the hydraulic component, which is connected to the turning handle via the connecting rod. This arrangement permits an operating mode described herein to be carried out via a knee-lever system. At the start, the connecting rod exerts force against the turning direction of the turning handle via the hydraulic component. After overpowering the mechanism past dead center, this force is decreased to zero. Then, another force is built up in the turning direction of the turning handle to thereby maintain the force exerted on the connecting rod via the hydraulic component in a fixed position. The force required to release the "knee joint" from the locked position depends on the predetermined overextension of the "knee joint."

Persons of ordinary skill in the art will further appreciate that the control element(s) for making fine adjustments of the side-to-side orientation or the height orientation of the weapon may comprise an adjustment gear which could be placed at the control unit. When placed at the end of the control unit, the adjustment gear is operatively connected to the control element (e.g., a turning handle) to enable continuous height or side-to-side adjustments. From the foregoing description, persons of ordinary skill in the art will also appreciate that the control elements for performing analogous functions are integrated by employing a coaxial assembly along the rotating axis of the turning handles. Consequently, in the case of a two-handle assembly, there is always a close control location connection between the control elements (i.e., the turning handle and the control gear) for the coarse and fine height adjustments. Similarly, there is a close control location connection between the control elements for the coarse and fine side-to-side adjustments. As a result, after suitable training, operation of the carriage (1) becomes intuitive, and it is, thus, especially easy for the shooter to adjust the gun carriage without taking his eyes off the sights.

In the illustrated example, the fine adjustment mechanisms operate by linear actuation. In particular, each of the fine adjustment mechanisms is implemented as a spindle transmission, more specifically, as a self-locking spindle transmission. This spindle transmission is coupled with a respective control gear via a bell crank gear, for instance, a bevel gear. It is possible to assemble the adjustable bell crank transmission at practically any angle relative to the axis of rotation of the control gear.

In the illustrated example, the control gears are equipped with fixed detents which define adjustment ranges that are calibrated to the respective firearm or sights such that the rotating angle between adjacent rotating positions of the control gear corresponds to a particular angle difference in the side or height direction. As a result, the shooter is able to perform a precise, tangible, and accurately defined readjustment of the directional position by rotating one or more of the gears. By coupling the gun mounting plate (13) to the base via a joint with two degrees of freedom, the continuous coarse adjustments and the more precise adjustments are completely mechanically decoupled. However, because of the special arrangement of the control elements, they are functionally integrated.

In the example illustrated herein, the joint is implemented by a joint rod (14) having two end-sections and a middle section between the two end-sections. Each of these sections is connected by means of tapered adapters. The bending and torsion resilience of the flexible joints of this joint rod (14), permits movement of the gun mounting plate (13) around a defined center of rotation with regard to the base (10) to thereby enable making adjustments.

In the illustrated example, the end sections are interconnected with the sidewalls of the base (10). At least one of the end sections is attached to the base as a fixed bearing. The middle section of the joint rod (14) is attached to the gun mounting plate (13). The actuators operate upon the gun mounting plate (13) and/or the base such that a firearm mounted on the gun mounting plate (13) turns around a center of rotation which is located on the axis of the joint rod (14) as soon as the actuators are activated.

In the illustrated example, there is an additional guidance between the gun mounting plate (13) and the base (10). This guidance transmits the recoil forces resulting from firing the weapon from the gun mounting plate (13) to the base (10) without excessively straining or warping the joint rod (14). This guidance may comprise, for instance, a guideway attached to the base (10) that runs transversely to the principal axis and which has a pin moving in the guideway. Characteristically, the guideway of the illustrated example runs in a radius of curvature which corresponds to the distance from the center of rotation of the adjustment joint rod (14).

The base (10) of the illustrated example is suspended in a pivot fork (8) via lateral trunnions (9) for the purpose of adjusting the height orientation of the base (10). The pivot fork (8), in turn, is mounted on a swing-out drum via a vertically running pivot pin (11) which is rotatable about a vertical axis for the purpose of adjusting the side-to-side orientation of the base (10). A first brake mechanism is provided between the base (10) and pivot fork (8) and a second brake mechanism is provided between the pivot fork (10) and the drum (12). These brake mechanisms interact with the actuators which are controlled by the respective control elements.

There gun carriage (1) of the illustrated example includes one or more triggers which are hydraulically coupled to the trigger mechanism of the weapon to permit firing of the weapon. The control concept realized in the gun carriage (1) may be used with various weapons which are, for instance, equipped with completely different trigger mechanisms (activation with the thumb, activation with the index finger, etc.). Since the firing actuator(s) of the gun carriage (1) need not necessarily change based on the type of weapon used with the carriage, a shooter familiar with the gun carriage (1) would not have any difficulty operating any weapon mounted on the carriage (1).

The versatility of the gun carriage (1) is increased by making use of adapters which form the cut surface between various types of guns and gun mounting plates. As a result, in general, any suitable weapon may be connected to the gun carriage (1) described above without having to make any changes on the gun carriage or on the weapon.

Finally, the gun carriage (1) described above may be used with a mounted weapon which is connected to a particular secondary gun carriage. This secondary gun carriage, in turn, is connected to a vehicle (103 0 or, by means of a suitable stand, to the ground or carrier in order to secure the weapon arrangement. In this way, by using the gun carriage (1), any operation with particular weapon arrangements could be performed.

It is noted that this patent claims priority from German Patent Application Serial Number DE 10 2004 043711.4, which was filed on Sep. 9, 2004, and is hereby incorporated by reference in its entirety.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A gun carriage for a firearm comprising:

a coarse height adjustment brake;

a coarse side-to-side adjustment brake;

a fine height orientation adjustment mechanism;

a fine side-to-side orientation adjustment mechanism;

a first control to actuate the coarse height adjustment brake;

a second control to actuate the fine height orientation adjustment mechanism;

a third control to actuate the coarse side-to-side adjustment brake;

a fourth control to actuate the fine side-to-side orientation adjustment mechanism; and first and second handles located at a rear of the gun carriage, and wherein the first handle comprises the first control and the first handle may be turned to transition the coarse height adjustment brake between a locked state and an unlocked state.

2. A gun carriage as defined in claim 1, wherein the first and second handles are oriented substantially transverse to a central axis of the gun carriage.

3. A gun carriage as defined in claim 1, wherein the first and second handles are configured to be gripped to perform at least one of coarse height or side-to-side orientation adjustments.

4. A gun carriage as defined in claim 1, further comprising an actuator associated with the first handle or the second handle to fire a firearm mounted on the gun carriage.

5. A gun carriage as defined in claim 1, wherein the first handle is connected to an actuator which releases the coarse height adjustment brake when the first handle is turned.

6. A gun carriage as defined in claim 5, wherein the actuator comprises a hydraulic piston, a hydraulic line, and a rod.

7. A gun carriage as defined in claim 6, further comprising a spring biasing the hydraulic piston and the rod toward a locked position, wherein after the first handle is turned within an adjustment range and released, the spring exerts a force via the hydraulic piston and the hydraulic line to return the first handle to a starting position.

8. A gun carriage as defined in claim 6, wherein the first handle is coupled to the hydraulic piston by a connecting rod which transmits a rotary motion of the first handle into a linear movement of the hydraulic piston.

9. A gun carriage as defined in claim 7, wherein turning the first handle beyond a dead center position, secures the first handle in a locked position to thereby secure the coarse height adjustment brake in the unlocked state.

10. A gun carriage as defined in claim 8, wherein a first end of the connecting rod is connected to the first handle via a first ball joint and a second end of the connecting rod is connected to the hydraulic piston via a second ball joint.

11. A gun carriage as defined in claim 1, wherein the fine height orientation adjustment mechanism and the fine side-to-side orientation adjustment mechanism are coupled to a gun mounting which is horizontally and vertically adjustable.

12. A gun carriage as defined in claim 11, wherein the fine height orientation adjustment mechanism comprises a first self-locking spindle transmission, and the fine side-to-side orientation adjustment mechanism comprises a second self-locking spindle transmission.

13. A gun carriage as defined in claim 11, wherein the gun mounting is coupled via a joint with two degrees of freedom with a pivot fork.

14. A gun carriage as defined in claim 13, further comprising a guideway oriented transverse to a principal axis of the carriage to receive a recoil force.

15. A gun carriage as defined in claim 13, wherein the pivot fork is suspended in a pivot dish via two trunnions to permit coarse height adjustments.

16. A gun carriage as defined in claim 14, wherein the guideway is coupled to the pivot fork and to the gun mounting.

17. A gun carriage as defined in claim 1, further comprising an adapter to mount a weapon to the gun carriage.

18. A gun carriage as defined in claim 1, further comprising: a firearm mounted on the gun carriage, wherein the gun carriage is mounted on a second gun carriage.

19. A gun carriage as defined in claim 18 wherein the second gun carriage is connected to a vehicle.

20. A gun carriage as defined in claim 18 wherein the second gun carriage comprises a stand.

21. A gun carriage for a firearm comprising:

a coarse height adjustment brake;

a coarse side-to-side adjustment brake;

a fine height orientation adjustment mechanism;

a fine side-to-side orientation adjustment mechanism;

a first control to actuate the coarse height adjustment brake;

a second control to actuate the fine height orientation adjustment mechanism;

a third control to actuate the coarse side-to-side adjustment brake;

a fourth control to actuate the fine side-to-side orientation adjustment mechanism; and first and second handles located at a rear of the gun carriage, and wherein the first handle comprises the third control, and the first handle may be turned to transition the coarse side-to-side adjustment brake between a locked state and an unlocked state.

22. A gun carriage as defined in claim 21, wherein the first handle is connected to an actuator which releases the coarse side-to-side adjustment brake when the first handle is turned.

23. A gun carriage as defined in claim 22, wherein the actuator comprises a hydraulic piston, a hydraulic line, and a rod.

24. A gun carriage as defined in claim 23, further comprising a spring biasing the hydraulic piston and the rod toward a locked position, wherein after the first handle is turned within an adjustment range and released, the spring exerts a force via the hydraulic piston and the hydraulic line to return the first handle to a starting position.

25. A gun carriage as defined in claim 23, wherein the first handle is coupled to the hydraulic piston by a connecting rod which transmits a rotary motion of the first handle into a linear movement of the hydraulic piston.

26. A gun carriage as defined in claim 24, wherein turning the first handle beyond a dead center position, secures the first handle in a locked position to thereby secure the coarse side-to-side adjustment brake in the unlocked state.

27. A gun carriage as defined in claim 25, wherein a first end of the connecting rod is connected to the first handle via a first ball joint and a second end of the connecting rod is connected to the hydraulic piston via a second ball joint.

28. A gun carriage for a firearm comprising:

a coarse height adjustment brake;

a coarse side-to-side adjustment brake;

a fine height orientation adjustment mechanism;

a fine side-to-side orientation adjustment mechanism;

a first control to actuate the coarse height adjustment brake;

a second control to actuate the fine height orientation adjustment mechanism;

a third control to actuate the coarse side-to-side adjustment brake;

a fourth control to actuate the fine side-to-side orientation adjustment mechanism; and first and second handles located at a rear of the gun carriage, and wherein one of the first control or the second control comprises a first control gear which is located at an end of the first handle, and one of the third control or the fourth control comprises a second control gear which is located at an end of the second handle.

29. A gun carriage as defined in claim 28, in which the first and second control gears are located coaxial to an axis of rotation of the first and second handles.

30. A gun carriage as defined in claim 28, further comprising a first set of evenly distributed detents defining a set of angular orientations for the first control gear, wherein an angular difference between each of the angular orientations in the set of angular orientations corresponds to a predetermined height adjustment.

31. A gun carriage as defined in claim 28, further comprising a first set of evenly distributed detents defining a set of angular orientations for the second control gear, wherein an angular difference between each of the angular orientations in the set of angular orientations corresponds to a predetermined side-to-side orientation adjustment.

32. A gun carriage for a firearm comprising:

a coarse height adjustment brake;

a coarse side-to-side adjustment brake;

a fine height orientation adjustment mechanism;

a fine side-to-side orientation adjustment mechanism;

a first control to actuate the coarse height adjustment brake;

a second control to actuate the fine height orientation adjustment mechanism;

a third control to actuate the coarse side-to-side adjustment brake; and a fourth control to actuate the fine side-to-side orientation adjustment mechanism, wherein the fine height orientation adjustment mechanism and the fine side-to-side orientation adjustment mechanism are coupled to a gun mounting which is horizontally and vertically adjustable, and wherein a first self-locking spindle transmission comprises a bevel gear coupled to the second control via a bell crank transmission, and a second self-locking spindle transmission comprises a bevel gear coupled to the fourth control via a bell crank transmission.

33. A gun carriage for a firearm comprising:

a coarse height adjustment brake;

a coarse side-to-side adjustment brake;

a fine height orientation adjustment mechanism;

a fine side-to-side orientation adjustment mechanism;

a first control to actuate the coarse height adjustment brake;

a second control to actuate the fine height orientation adjustment mechanism;

a third control to actuate the coarse side-to-side adjustment brake; and a fourth control to actuate the fine side-to-side orientation adjustment mechanism, wherein the fine height orientation adjustment mechanism and the fine side-to-side orientation adjustment mechanism are coupled to a gun mounting which is horizontally and vertically adjustable, and wherein the gun mounting is coupled via a joint with two degrees of freedom with a pivot fork, and wherein the joint with two degrees of freedom comprises a joint rod having two end sections and a middle section, a first flattened adapter couples a first one of the end sections to the middle section, and a second flattened adapter couples a second one of the end sections to the middle section.

34. A gun carriage as defined in claim 33, wherein the joint rod is oriented substantially transverse to a principal axis of the carriage, the end sections engage respective sidewalls of a base surrounding the gun mounting, and the middle section of the joint rod is connected to the gun mounting.

35. A gun carriage as defined in claim 34, wherein one of the end sections is axially movable within the respective sidewall of the base.

36. A gun carriage for a firearm comprising:

a coarse height adjustment brake;

a coarse side-to-side adjustment brake;

a fine height orientation adjustment mechanism;

a fine side-to-side orientation adjustment mechanism;

a first control to actuate the coarse height adjustment brake;

a second control to actuate the fine height orientation adjustment mechanism;

a third control to actuate the coarse side-to-side adjustment brake; and a fourth control to actuate the fine side-to-side orientation adjustment mechanism, wherein the fine height orientation adjustment mechanism and the fine side-to-side orientation adjustment mechanism are coupled to a gun mounting which is horizontally and vertically adjustable, and wherein the gun mounting is coupled via a joint with two degrees of freedom with a pivot fork, and wherein the pivot fork is suspended in a pivot dish via two trunnions to permit coarse height adjustments, and wherein the pivot dish is mounted on a drum via a pivot pin to permit coarse side-to-side adjustments.

37. A gun carriage as defined in claim 36, wherein the coarse height adjustment brake releasably precludes movement between the pivot fork and the pivot dish, and the coarse side-to-side adjustment brake releasably precludes movement between the pivot dish and the drum.

38. A gun carriage for a firearm comprising:

a coarse height adjustment brake;

a coarse side-to-side adjustment brake;

a fine height orientation adjustment mechanism;

a fine side-to-side orientation adjustment mechanism;

a first control to actuate the coarse height adjustment brake;

a second control to actuate the fine height orientation adjustment mechanism;

a third control to actuate the coarse side-to-side adjustment brake;

a fourth control to actuate the fine side-to-side orientation adjustment mechanism; and an actuator associated with the first handle or the second handle to fire a firearm mounted on the gun carriage, wherein the actuator operatively engages a first hydraulic piston, a hydraulic line, and a second hydraulic piston, the first hydraulic piston operatively engages a connecting rod which is in operative engagement with the actuator, and the second hydraulic piston operatively engages a trigger of the firearm mounted on the gun carriage.

* * * * *